US007677840B2

(12) United States Patent
Rabichev et al.

(10) Patent No.: US 7,677,840 B2
(45) Date of Patent: Mar. 16, 2010

(54) GREEN RETAINING WALL UTILIZING HELICAL PIERS

(75) Inventors: Val A. Rabichev, San Francisco, CA (US); Chris Baumsteiger, 10 Buckeye Cir., Woodacre, CA (US) 94973

(73) Assignees: Val Rabichev, San Francisco, CA (US); Chris Baumsteiger, San Francisco, CA (US)

( * ) Notice: Subject to any disclaimer, the term of this patent is extended or adjusted under 35 U.S.C. 154(b) by 0 days.

(21) Appl. No.: 12/354,746

(22) Filed: Jan. 15, 2009

(65) Prior Publication Data

US 2009/0202309 A1 Aug. 13, 2009

Related U.S. Application Data

(60) Provisional application No. 61/065,196, filed on Feb. 7, 2008.

(51) Int. Cl.
*E02D 29/02* (2006.01)

(52) U.S. Cl. ..... 405/262; 405/284; 405/285

(58) Field of Classification Search ..... 405/284, 405/285, 286, 262
See application file for complete search history.

(56) References Cited

U.S. PATENT DOCUMENTS

| | | | | | |
|---|---|---|---|---|---|
| 3,728,862 | A * | 4/1973 | Meredith | 405/285 |
| RE28,977 | E * | 9/1976 | Mason | 405/262 |
| 3,999,391 | A * | 12/1976 | Meredith | 405/262 |
| 4,117,686 | A | 10/1978 | Hilfiker | |
| 4,303,355 | A * | 12/1981 | Vilcinskas | 405/262 |
| 4,671,706 | A | 6/1987 | Giardini | |
| 4,690,588 | A * | 9/1987 | Berger | 405/262 |
| 4,725,168 | A * | 2/1988 | Fagundes | 405/262 |
| 4,914,876 | A | 4/1990 | Forsberg | |
| 4,920,712 | A | 5/1990 | Dean, Jr. | |
| 5,171,107 | A | 12/1992 | Hamilton et al. | |
| 5,588,784 | A * | 12/1996 | Brandl et al. | 405/262 |
| 5,707,180 | A | 1/1998 | Vickars et al. | |
| 6,299,386 | B1 * | 10/2001 | Byrne et al. | 405/262 |
| 6,872,031 | B2 | 3/2003 | May | |
| 6,893,191 | B2 * | 5/2005 | Weyant et al. | 405/284 |
| 6,935,812 | B2 | 8/2005 | Rainey | |
| 7,059,807 | B2 * | 6/2006 | Irvine | 405/262 |
| 2004/0013474 | A1 * | 1/2004 | Weyant et al. | 405/262 |
| 2006/0010819 | A1 * | 1/2006 | Irvine et al. | 52/583.1 |
| 2007/0092343 | A1 * | 4/2007 | Cargill et al. | 405/284 |

* cited by examiner

*Primary Examiner*—Frederick L Lagman
(74) *Attorney, Agent, or Firm*—Chris Baumsteiger; Val Rabichev

(57) ABSTRACT

The present invention provides a system and a method for a retaining wall which minimizes cost, assembly time and environmental impact while providing substantial load-bearing capacity. The system includes: a plurality of vertical helical piers driven into the ground, tie-back helical piers driven at a non-vertical angle into the ground, substantially horizontal waler rods, and substantially vertical extensions, which are interconnected through interlocking connectors. Multiple levels of the load-bearing structure can be built on top of each other depending on the height of the soil to be retained. Loads from the retained soil may be transferred to the extension bars and waler rods through wood lagging, wood planks, different types of plates, or some other intermediary. A mesh support for the soil can be provided in addition to the load-bearing structure. Trees, bushes or other plants can be planted through the mesh in the retained soil to improve the environmental impact of the invention.

3 Claims, 5 Drawing Sheets

GREEN RETAINING WALL UTILIZING HELICAL PIERS

CROSS-REFERENCES TO RELATED APPLICATIONS

This application claims the benefit under 35 U.S.C. §119 (e) of U.S. Provisional Patent Application No. 61/065,196, filed Feb. 7, 2008, the full disclosure of which is incorporated herein by reference.

BACKGROUND OF THE INVENTION

The present invention relates to systems and methods for retaining walls that support vertical or inclined excavation cuts, embankments and the like. In particular, the present invention introduces an environmentally friendly, modular and inexpensive way of structurally supporting soil through helical piers driven into the ground, horizontal waler rods, vertical extensions and interlocking connectors. The resulting structure can withstand high structural loads, while creating a minimal environmental impact.

Retaining walls in civil engineering serve to prevent erosion or a collapse of excavation cuts and soil embankments. They must withstand significant structural loads, while minimizing the cost, the time to erect, and their environmental impact. The retained soil may be vertical or inclined, which poses different types of issues to be dealt with, an inclined wall being more prone to the erosion problems, while vertical walls are more prone to a collapse.

The need for retaining walls has been recognized in civil engineering for a long time. Many methods for building retaining walls have been developed. Traditionally, retaining walls have been made, for example, of a contiguous wire mesh, concrete or brick blocks with interlocking features, or by pouring concrete that is typically supported by structural steel beams. Some of these traditional methods have significant environmental impact, like, for instance, pouring concrete and/or driving the steel beams into the ground. This type of retaining wall can have an extremely high bearing capacity, but the cost and the environmental impact, both to erect and to remove, of such a wall are very significant. Some other retaining walls are made of interlocking brick or concrete elements. Such retaining walls are well-suited for the inclined soil slope, but are usually not useful for building vertical walls due to their inherently weak lateral load-bearing capacity.

Other retaining walls rely on boxes or wire mesh cages that are pre-filled with stone, brick or soil. These walls occupy significant lateral space in order to achieve the requisite load bearing for the vertical walls. Retaining walls are also built by first creating a strong L-shaped wire mesh surface. Next, the space between the wire mesh and the inclined soil surface is filled with soil or rock. The resulting structure tends to have significant load-bearing capacity, but is expensive, non-removable and environmentally degrading.

There are also retaining walls that use helical piers as a foundation element which is positioned in the soil. One such method creates an in-situ pile with soil displacer plates, which create a hollow cylindrical space in the tail of a helical pier rotated into the ground. Next, a column of concrete is built on top of this created foundation element. However, these methods are quite invasive due to the augered nature of the tie-back to the helical pier, and they result in essentially a non-removable retaining wall.

Thus, there exists a need for systems and methods for building the retaining walls with significant load-bearing capacity, modular structure, short assembly time, and minimal environmental impact.

BRIEF SUMMARY OF THE INVENTION

The present invention provides a system and a method for a retaining wall which minimize cost, assembly time and environmental impact while providing substantial load-bearing capacity.

An important feature of the present invention is that it permits the ready strengthening of existing or newly built retaining walls that, by themselves, have insufficient strength and durability to retain an embankment, for example, and prevent an eventual deterioration and collapse of the wall.

Generally speaking, the present invention can be used, for example, to strengthen a wooden retaining wall constructed of horizontally oriented boards that abut against the cut or embankment (hereafter "soil" for short) supported, on the outer side of the boards, by upright or uprightly inclined vertical lagging, frequently made of 4"×6" lumber. Such a wall by itself has little ability to withstand movement of the soil and will collapse after a relatively short service life.

The present invention is also useable with a large variety of prior art retaining wall structures for vertical and/or sloping embankments. For example, it can be used with a retaining wall that is initially formed by weaving a Geotextile fabric back and forth in an upward direction and placing a narrow, e.g. 2'-wide, soil layer on the Geotextile fabric at the bottom of the trench, and then weaving the fabric over the deposited soil. Another layer of soil is then placed over the exposed fabric, and weaving the fabric back and forth is continued over successive additional soil layers until the desired height has been reached. The Geotextile fabric has excellent soil-retaining qualities but little strength. Thus, like in the case of a retaining wall made of wooden boards and lagging, the "woven" Geotextile fabric/soil layers will move and fail.

Both types of the specifically described retaining walls, as well as others, are desirable because they are environmentally friendly, require little disturbance of the soil along the embankment, introduce a minimal amount of foreign materials to the site, and permit plantings into the wall through holes provided for this purpose to render the wall attractive and more green.

This is accomplished in accordance with the present invention by providing a harness over the exterior of the wall that has upright, typically vertically oriented or slightly inclined, helical piers, helical tie-back piers which extend at an angle to the horizontal through the embankment into the soil behind it, connectors which are secured to the helical piers and tie-backs, and generally horizontally oriented waler rods secured to the connectors and arranged so that they contact and provide support for the upright lagging or the Geotextile fabric, for example, of the retaining wall. The connector itself is securely tightened to the helical pier and the inclined tie-back rods to provide vertical and horizontal support for the retaining wall. The resulting harness leaves most of the attractive retaining wall, whether it be a wooden wall, a Geotextile fabric wall, or a wall made of another material. The wall remains visible and is only very slightly obstructed by the vertical pier rods, the waler rods and the connectors between them. As a result, access to the soil behind the retaining wall can be provided through relatively small openings where vegetation, brush and the like can be planted which both enhance the aesthetic appearance of the wall while the root system of the vegetation strengthens and solidifies the soil behind the wall.

Thus, the system of the present invention has helical piers driven into the soil that provide anchoring resistance against the load exerted on the retaining wall by the retained soil. Multiple levels of the load-bearing structure can be built on top of each other depending on the height of the soil to be retained. Loads from the retained soil are transferred to the extension bars and waler rods through wood lagging, wood panels, different types of plates, or some other intermediary. A mesh support for the soil can be provided in addition to the load-bearing structure. Trees, bushes or other plants can be planted through the mesh in the retained soil to improve the environmental impact of the invention.

In one embodiment, the system includes a plurality of helical piers, vertical extension bars, horizontal waler rods and interlocking connectors with a system of holes configured to receive the helical piers, the vertical extension bars and the horizontal waler rods, and to securely tie the structural elements within the interlocking connectors using bolts and washers to form the retaining wall holding and constraining harness.

In one aspect, the interlocking hardware has slotted holes for the horizontal waler rods to provide for better flexibility and higher load bearing.

In another aspect, a mesh is used to contain soil behind the retaining wall.

In yet another aspect, trees or bushes are planted in the retained soil through the opening in the mesh.

DETAILED DESCRIPTION OF THE INVENTION

The embodiments of the present invention are directed toward systems and methods for a soil retaining wall which minimize cost, assembly time and environmental impact while providing a substantial load-bearing capacity. The details of an exemplary embodiment of the present invention are explained with reference to FIGS. 1-4. The exemplary embodiment is described with reference to a two-level system, but it will be clear to a person skilled in the art that the described system and method can be used for any number of levels, depending on the height of the soil to be retained. Also, vertical wood lagging is illustrated as the load transmitter between the soil and the described embodiment, but a person skilled in the art would readily know of other suitable materials in other shapes that may be used.

Figure 1:
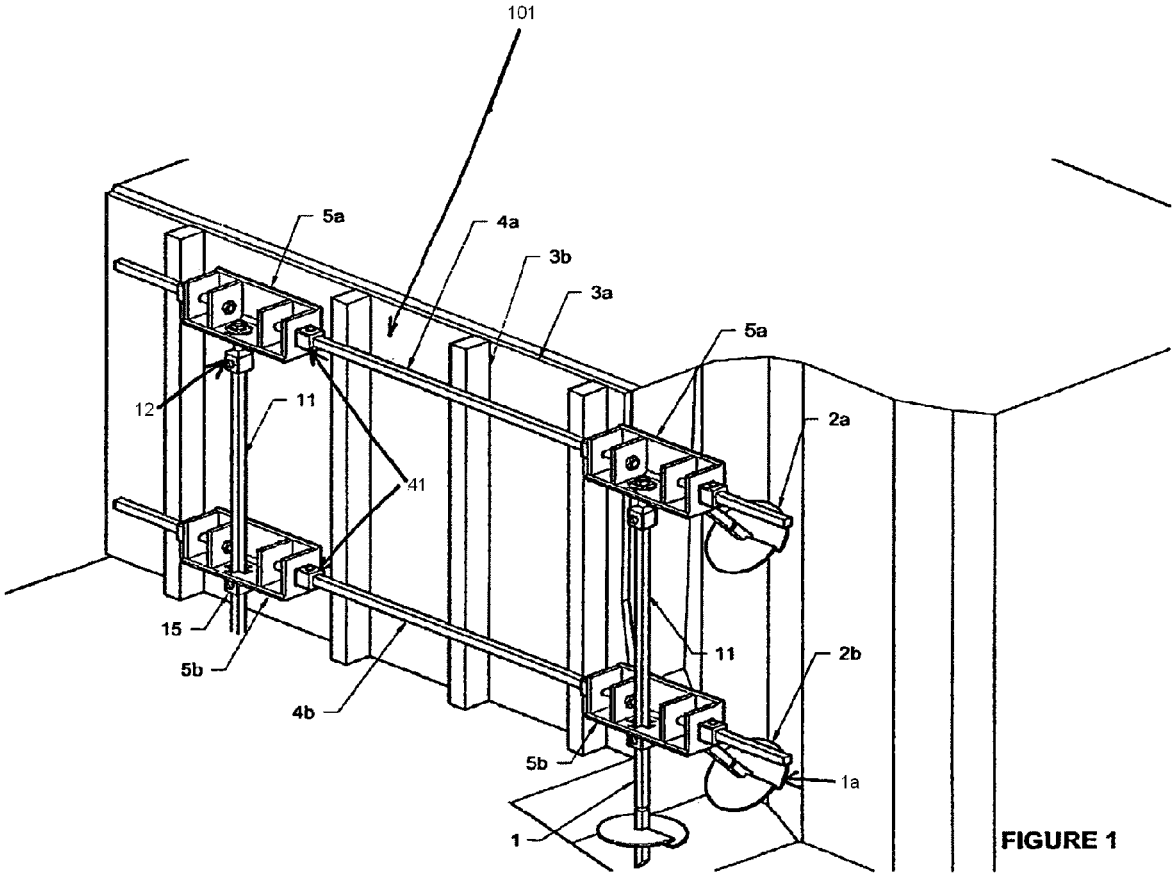
FIG. 1 is a perspective view of the wall retaining system installed to support a vertical retaining wall using wood lagging.

FIG. 1 shows a wall retaining system or harness 101 that includes a vertical helical pier lead section 1, which is rotated into the ground to a required depth. Helical piers generally have sectional steel shafts or pipes with blades welded thereon to facilitate penetration into the soil. The pier extensions can be coupled onto helical pier lead sections using various common techniques, such as a male-female slotted assembly or concentric pipes connected with through-bolts. As the lead section 1 is rotated by means of an external torque tool, lead section 1 is pulled deeper into the ground by the helical blade 1*a*. The rotation of the helical pier drives lead section 1 deeper down into the soil, about one helical pitch per rotation.

A person skilled in the art would know of a variety of tools that can provide the requisite torque on the helical pier. Torque tools at the construction sites are typically pneumatically or electrically driven. A particular torque value corresponding to the ultimate torque capacity of the pier can be dialed in the torque tools. The extension rods (not shown on the drawing) can be attached to helical piers if they need to be driven deeper into the ground.

An upper extension 11 is attached onto helical pier 1 using a standard threaded adapter 15. A variety of standard helical piers, extension rods and threaded adapters is available on the market to a person skilled in the art. For example, a suitable threaded adapter is catalog item C110-0026 of the A.B. Chance Company.

Tie-back helical piers 2*a* and 2*b* at an upper portion of the retaining wall are rotated into the ground at an inclined angle to the horizontal to provide the lateral force retaining capacity of the retaining wall. The inventors have found that for the vertical retaining walls an angle of about 45° works best for the tie-back helical piers. If lagging 3*a* is in place on the ground prior to inserting the tie-back helical piers into the ground, then a hole bigger than the diameter of the helical pier is first drilled through lagging 3*a*. The vertical helical piers 1, together with the tie-back piers 2*a* and 2*b*, provide the required anchoring of the system into the ground, using the connecting hardware, as explained in detail below.

The lower level of the retaining wall hardware is assembled as follows. Interlocking connectors 5*b* are lowered down the top extension 11 through a slotted hole 54 (shown in FIG. 3A). Slotted hole 54 has tolerance allowing extension 11 to pass through, and also for a play between the parts which is needed during the assembly process. After sliding down the extension 11, interlocking connector 5*b* rests on coupler 15, which is a standard threaded adapter. The vertical component of the force exerted by the retained soil is transferred via the interlocking connector 5*b* onto coupler 15 and further onto vertical helical pier 1. Next, generally horizontally oriented waler rods 4*b* are extended into interlocking connectors 5*b* through holes 56 and 57 (shown in FIG. 3A). Threaded adapters 41 are positioned in the proximity of connector 5*b* walls, and they are tightened to secure the waler rods to the connectors. The waler rods are preferably slender steel rods which resist lateral earth pressure due to the unique combination of bending and tension stresses in the rods, and the rods in turn are supported by the interlocking connectors.

The ends of the tie-back piers 2*b* are positioned into interlocking connectors 5*b* through slotted holes (shown in FIG. 3B) in the back of interlocking connectors.

The next level of the retaining wall hardware is assembled as follows. Interlocking connectors 5*a* are lowered down the threaded end of extensions 11 through slotted holes 54 until they rest on threaded adapters 12. Waler rods 4*a* are passed through holes 56 and 57. Threaded adapters 41 are tightened close to the connector 5*a* walls. The ends of the tie-back piers 2*a* are positioned into interlocking connectors 5*a* through slotted holes in the back of interlocking connectors 5*a*.

A person skilled the art understands that the above-described process can be repeated to build up the additional layers of the retaining wall to practically any desired height as dictated by the height of the embankment or soil cut. Similarly, an appropriate number of horizontal elements can be used to lengthen the retaining wall as needed. The vertical piers and the tie-back piers are installed at a fixed spacing, determined by the soil pressure conditions, and constituting the primary load resistance axles. The calculations needed therefor are known to a person skilled in the art.

Figure 3A:
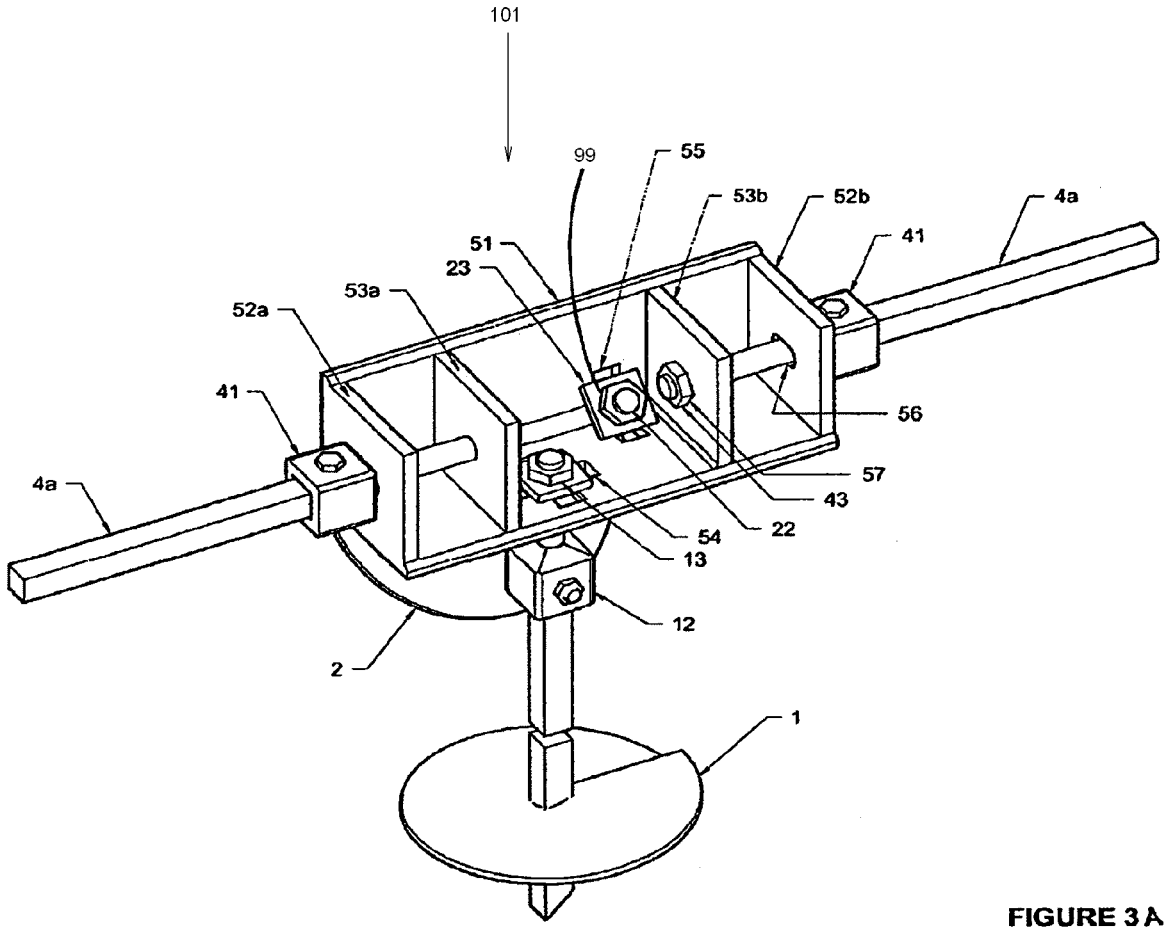
FIG. 3A is a front perspective view of an interlocking connector located at the top row of the system.
Figure 3B:
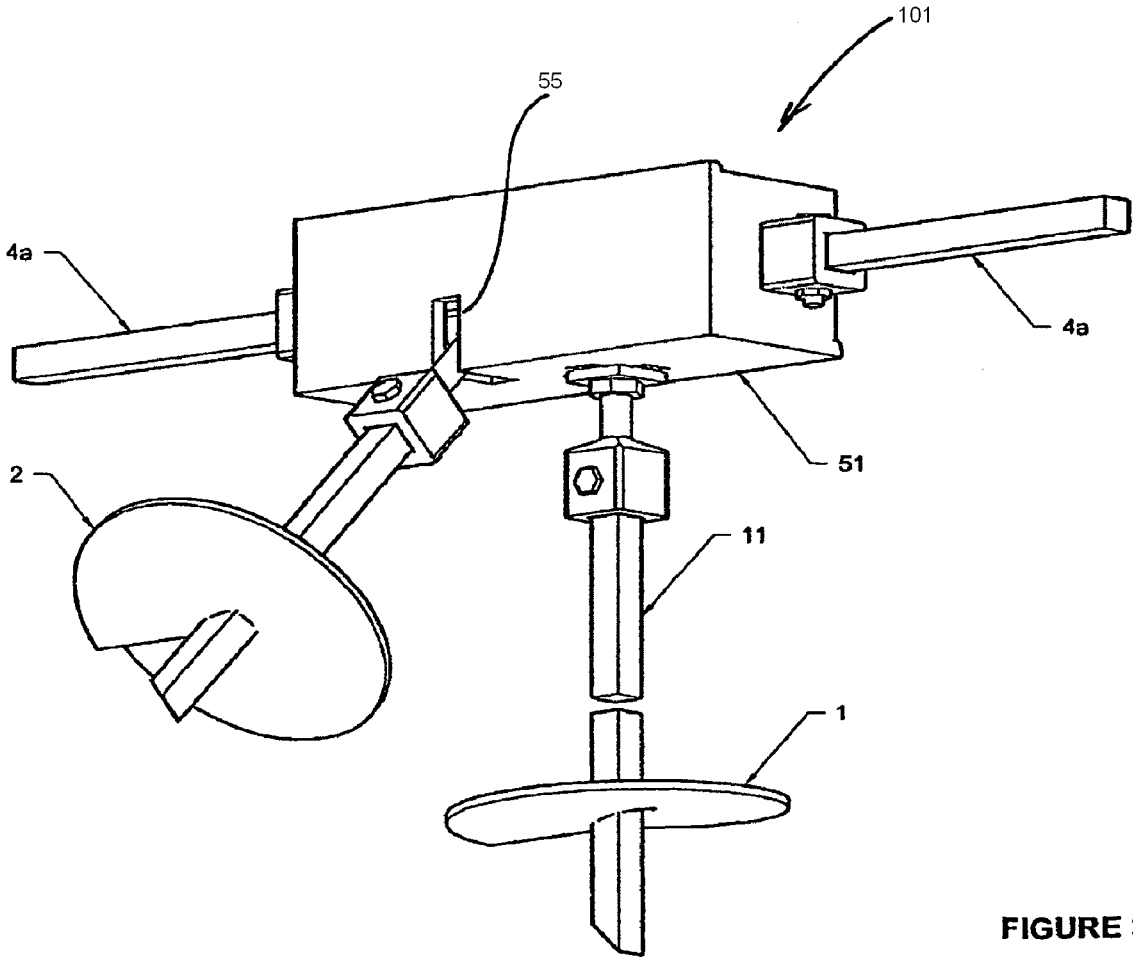
FIG. 3B is a back perspective view of the interlocking connector at the top row of the system.

FIGS. 1, 3A and 3B illustrate the interconnection of the waler rods, extensions (or lead sections) and tie-back piers into a retaining wall supporting system or harness 101 which is defined by the vertical extensions 11 that extend upwardly from the helical piers, tie-back piers 2*a*, waler rods 4*a* and connectors 5*a*, all of which are securely connected to each other as is further described below. The interlocking connector 51 can be an L-profile 51 which may be 8"×8"×½" or of a similar size. In one embodiment, connector 51 is outfitted with two sets of stiffener plates: end plates 52*a*, 52*b* and middle plates 53*a*, 53*b*, which are welded to the L-profile. The stiffener plates serve for waler rod attachment. Nuts 43 are tightened over threaded waler rod ends that protrude through holes 57 on stiffener plates 53*a* and 53*b*. Stiffener plates 52*a* and 52*b* have horizontally slotted holes 56. The horizontal slot on hole 56 provides some tolerance of the waler position and allows for some movement away from the soil for walers which are under a lateral load from the soil. This, in turn, increases the load-bearing capacity of the retaining wall since the stresses in the walers begin to more closely approximate a pure tension case, while shear stresses in the walers are reduced.

Vertical extension 11 has a standard threaded adapter 12 attachment protruding through slotted hole 54. Cooperating nut 13 and washer 54 are used to tighten standard thread adapter 12 against the bottom of the interlocking connector. The inclined tie-back pier 2 (best seen in FIG. 3B) ends in a threaded adapter 22 that protrudes through hole 55 of the interlocking connector. The rotation of nut 99 or adapter 22 tightens the tie-back pier to the interlocking connector and, if continued, the rotation of nut 99 can be used to move the interlocking connector along threaded adapter 12 to thereby move that section of the retaining wall closer to the soil surface. In this manner, the position of the retaining wall section can be changed from, for instance, 90° (vertical wall) to an inclined retaining wall by the rotation of nut 99.

Figure 4:
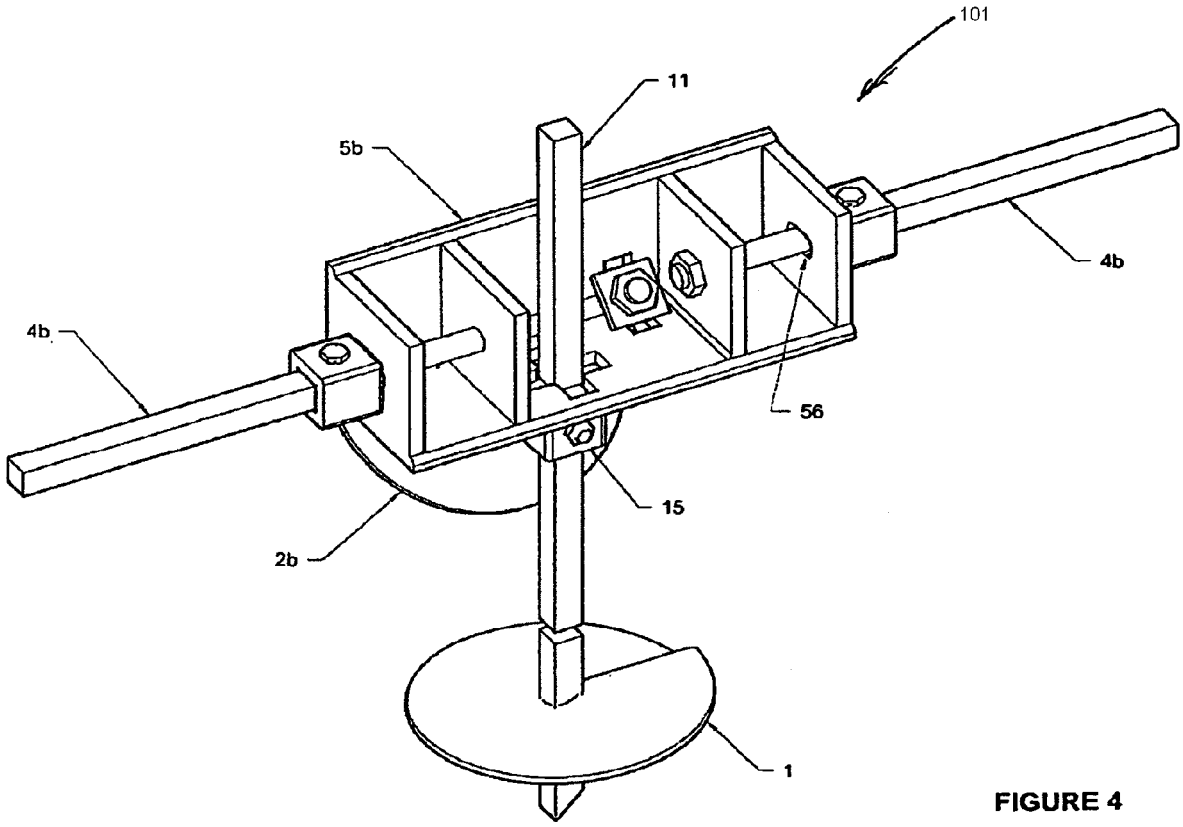
FIG. 4 is a front perspective view of the interlocking connector at the intermediate or bottom row of the structure.

FIG. 4 illustrates the interlocking connector at the intermediate or bottom row of walers and tie-backs. Notice that the vertical helical pier shaft does not terminate with a threaded adaptor as in the top row. Instead, vertical extension 11 protrudes upwardly past the interlocking connector. Coupler 15 is provided to transfer the vertical component of the force down onto the vertical pier 1.

Returning now to FIG. 1, a barrier against the soil, for instance wooden boards 3*a*, is shown. The boards 3*a* transfer the lateral soil pressure to upright lagging 3*b*, and then to waler rods 4*a* and 4*b*, and ultimately through the interlocking connectors, to the tie-back and the vertical helical piers. Boards 3*a* and laggings 3*b*, which may be made of wood or other suitable material, can be drilled to form holes through which trees, bushes or other vegetation can be planted to further strengthen and beautify the retaining wall, as well as to provide additional environmental benefit. Applicants have found that willow and similar plant species work very well for this purpose.

Figure 2:
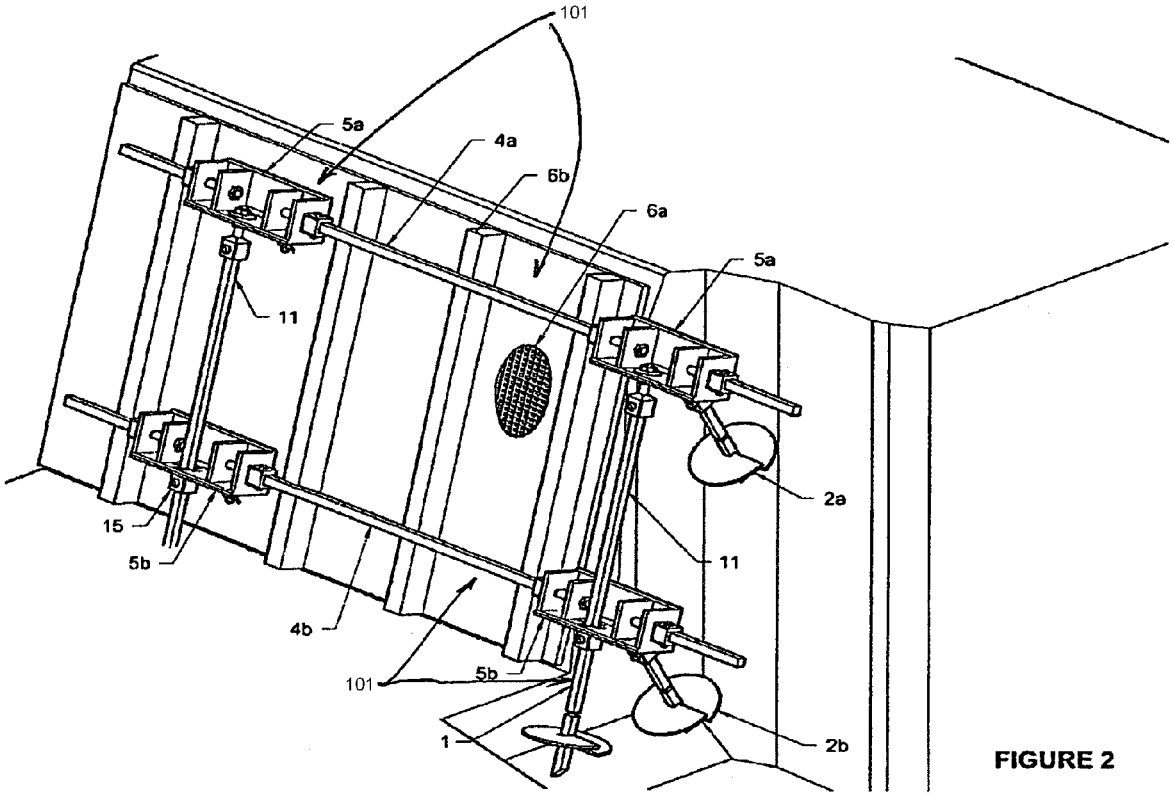
FIG. 2 is a perspective view of the wall retaining system installed to support an inclined soil surface with a cut-out showing a mesh for soil retaining.

FIG. 2 illustrates an embodiment with an inclined retaining wall. A partial cut-out in FIG. 2 shows wire or plastic mesh 6*a* used to further contain soil behind the wood boards and lagging 3*a*, 3*b*. Applicants have found that Soil Reinforcement meshes available from the Geotextile company work well. Holes can be cut through the mesh to accommodate shoots of trees or bushes.

The above description is illustrative, and is not restrictive. Many variations in the equipment and manufacturing process will become apparent to those skilled in the art upon review of the disclosure. And, as will be understood by those skilled in the art, the present invention may be embodied in other specific forms without departing from the essential characteristics thereof.

What is claimed is:

1. A retaining wall comprising a plurality of substantially vertical helical piers driven into the ground, tie-back helical piers driven non-vertically into the ground, substantially horizontal waler rods, and substantially vertical extensions, which are interconnected through interlocking connectors, said interlocking connectors comprising a system of holes configured to receive and to securely tie said vertical helical piers, said tie-back helical piers, said waler rods, and said extensions using bolts and washers.

2. A retaining wall for securing a soil embankment or cut comprising a retaining wall in contact with the soil embankment extending from a base of the embankment or cut in upward and horizontal directions, and a retaining wall harness positioned on the side of the retaining wall structure opposite from the embankment and including at least two horizontally substantially aligned and spaced-apart connectors located above a lower end of the retaining wall structure and below an upper end of the retaining wall structure, a waler rod generally horizontally extending between the connectors and in contact with at least portions of the retaining wall structure, a substantially vertical helical pier extending from the soil in an upright direction and secured to the connector, and a non-vertical helical tie-back rod extending from the soil past the retaining wall structure and secured to the connector, the helical pier and the helical tie-back being respectively firmly anchored to the soil below and behind the retaining wall structure and providing support for the retaining wall structure against movement.

3. A retaining wall according to claim 1 wherein the waler rod comprises slender steel rods.

* * * * *